US005622054A

United States Patent [19]

Tingle

[11] Patent Number: 5,622,054

[45] Date of Patent: Apr. 22, 1997

[54] LOW $NO_x$ LOBED MIXER FUEL INJECTOR

[75] Inventor: Walter J. Tingle, Danvers, Mass.

[73] Assignee: General Electric Company, Cincinnati, Ohio

[21] Appl. No.: 577,074

[22] Filed: Dec. 22, 1995

[51] Int. Cl.[6] ..... F02C 1/00

[52] U.S. Cl. ..... 60/737; 60/742; 60/748

[58] Field of Search ..... 60/737, 740, 742, 60/743, 748, 749; 239/416.4, 416.5, 423, 419, 432, 424.5

[56] References Cited

U.S. PATENT DOCUMENTS

| | | | |
|---|---|---|---|
| 3,937,008 | 2/1976 | Markowski et al. | 60/39.06 |
| 5,207,064 | 5/1993 | Ciokajlo et al. | 60/737 |
| 5,235,813 | 8/1993 | McVey et al. | 60/737 |
| 5,251,447 | 10/1993 | Joshi et al. | 239/424.5 |

*Primary Examiner*—Charles G. Freay
*Attorney, Agent, or Firm*—Andrew C. Hess; Wayne O. Traynham

[57] ABSTRACT

A fuel injector includes outer and inner coaxial shells spaced radially apart to define a flow channel therebetween having an inlet and an outlet. A strut extends radially outwardly from the inner and outer shells at leading edges thereof and is fixedly joined thereto. An annular lobed mixer is disposed coaxially in the channel and includes a leading edge, a trailing edge spaced from the channel outlet to define a mixing nozzle, and a plurality of circumferentially spaced apart lobes increasing in radial height from the leading to trailing edges of the mixer. The lobes defines with the outer and inner shells corresponding pluralities of outer and inner chutes for separately channeling respective portions of inlet air. The fuel is injected into the lobed mixer forming a fuel and air mixture in the mixing nozzle for discharge through the channel outlet into a combustor.

10 Claims, 2 Drawing Sheets

LOW $NO_x$ LOBED MIXER FUEL INJECTOR

BACKGROUND OF THE INVENTION

The present invention relates generally to low NOx gas turbine engines, and, more specifically, to a fuel injector therefor.

A gas turbine engine includes a compressor for compressing air which is mixed with fuel and ignited in a combustor for generating hot combustion gases which flow downstream into one or more stages of turbines which extract energy therefrom. An industrial turbine engine is typically used for powering an electrical generator for producing electrical power to a utility grid, and it is desirable to operate the engine with relatively low NOx emissions. A low NOx engine may be operated with steam injection for more effectively achieving low NOx emissions. However, operating a turbine engine dry, or without steam injection, increases the difficulty of achieving suitably low NOx emissions.

Dry low NOx engines require extremely fine control of combustor stoichiometry and very high fuel and air mixing effectiveness. Current engines attempt to achieve these high levels of mixing effectiveness with conventional coannular swirl vane mixers and corresponding fuel injection orifices in which the air and fuel passages require very tight or small dimensional control.

For example, in a conventional fuel injector having coannular swirl vanes, an outer row of swirl vanes is angled circumferentially for swirling the air in one direction, with an inner row of swirl vanes being angled circumferentially in an opposite direction for counter swirling air. Each of the flow passages between circumferentially adjacent ones of the vanes has a throat of minimum flow area which meters the air. And, the fuel is separately metered through corresponding fuel orifices. In order to effect uniform mixing for reducing NOx emissions, the individual vane areas from passage to passage and from fuel injector to fuel injector must be closely matched for correspondingly controlling the fuel-to-air ratio therefrom. Accordingly, the manufacturing process is relatively complex and time consuming to ensure that the vane-to-vane throat areas are within suitably small variations. As engine size decreases, the manufacturing degree of difficulty increases until limited by typical manufacturing dimensional tolerances which prevent further miniaturization for use on small engines.

Furthermore, the individually angled swirl vanes necessarily provide a reduced component of axial velocity since the air is swirled in part circumferentially. In order to provide a sufficient margin of flashback prevention, the axial velocity of the fuel and air mixture discharged from each fuel injector into the combustor should be greater than the conventionally known turbulent flame speed of the fuel and air mixture. Since swirling decreases the axial component of velocity, the swirlers must be made sufficiently larger in size so that the resulting axial component of velocity is greater than the turbulent flame speed.

Yet further, the counterrotating swirling mixtures discharged from the fuel injector into the combustor have a radially varying velocity distribution which affects the combustion process. The discharge velocity is typically low at the centerline of the swirlers and increases radially outwardly. The lower velocity increases undesirable stagnation of the fuel and air mixture, with the fuel injector typically also including a center passage for channeling a portion of the air therethrough for reducing the local stagnation effect.

Accordingly, all of these design factors cooperate together to increase the difficulty of achieving maximum fuel and air mixing with accurate fuel and air metering for promoting low NOx combustion in a gas turbine engine. And, these factors increase the difficulty of achieving low NOx combustion as the size of the fuel injector decreases.

SUMMARY OF THE INVENTION

A fuel injector includes outer and inner coaxial shells spaced radially apart to define a flow channel therebetween having an inlet and an outlet. A strut extends radially outwardly from the inner and outer shells at leading edges thereof and is fixedly joined thereto. An annular lobed mixer is disposed coaxially in the channel and includes a leading edge, a trailing edge spaced from the channel outlet to define a mixing nozzle, and a plurality of circumferentially spaced apart lobes increasing in radial height from the leading to trailing edges of the mixer. The lobes defines with the outer and inner shells corresponding pluralities of outer and inner chutes for separately channeling respective portions of inlet air. The fuel is injected into the lobed mixer forming a fuel and air mixture in the mixing nozzle for discharge through the channel outlet into a combustor.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
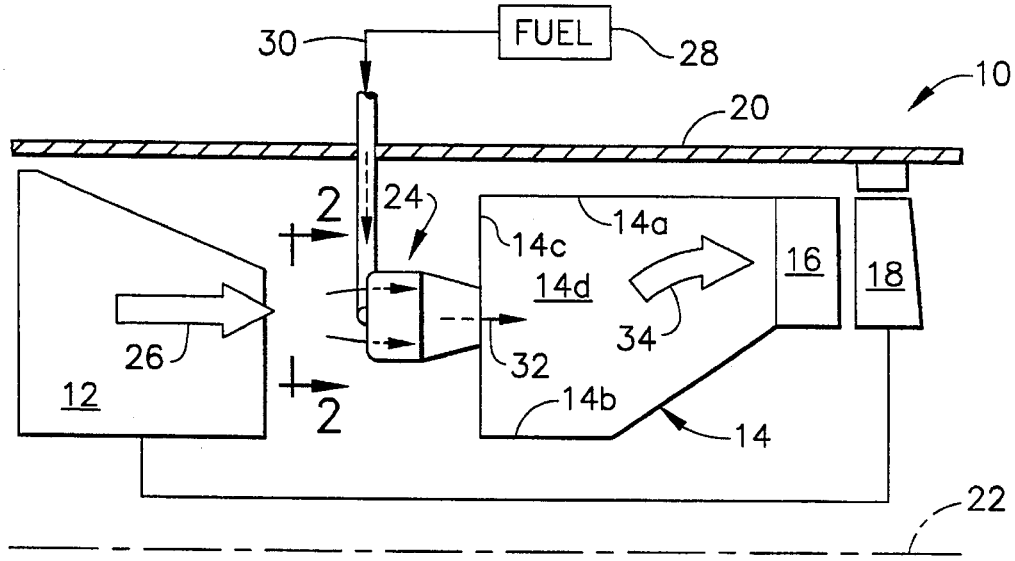
FIG. 1 illustrates schematically an exemplary low NOx gas turbine engine having improved fuel injectors therein in accordance with one embodiment of the present invention.

Illustrated schematically in FIG. 1 is a portion of a low NOx gas turbine engine 10 including in serial flow communication a compressor 12, a combustor 14, a high pressure turbine nozzle 16, and a high pressure turbine rotor 18 joined to the compressor 12 by a suitable shaft, all of which are conventional. The engine includes an outer casing 20 surrounding these components and is axisymmetrical about a longitudinal centerline axis 22.

The combustor 14 includes radially outer and inner annular combustion liners 14*a,b* joined together at upstream ends at an annular dome 14*c*, and between which is defined an annular combustion chamber 14*d*. In accordance with one embodiment of the present invention, a plurality of circumferentially spaced apart fuel injectors 24, also referred to as fuel cups, are disposed in flow communication with the combustion chamber 14*d* at the combustor dome 14*c* for providing fuel and air therein for effecting low NOx combustion.

More specifically, ambient air is channeled through the compressor 12 wherein it is pressurized to form compressed air 26 which flows downstream through each of the fuel injectors 24. A conventional fuel supply 28 provides a gaseous fuel 30 through each of the fuel injectors 24 wherein it is mixed with the compressed air 26 and discharged from the fuel injectors 24 as a fuel and air mixture 32 which is conventionally ignited for generating hot combustion gases 34 which flow downstream from the combustor 14 and through the nozzle 16 and rotor 18 for conventionally powering the compressor 12.

Figure 2:
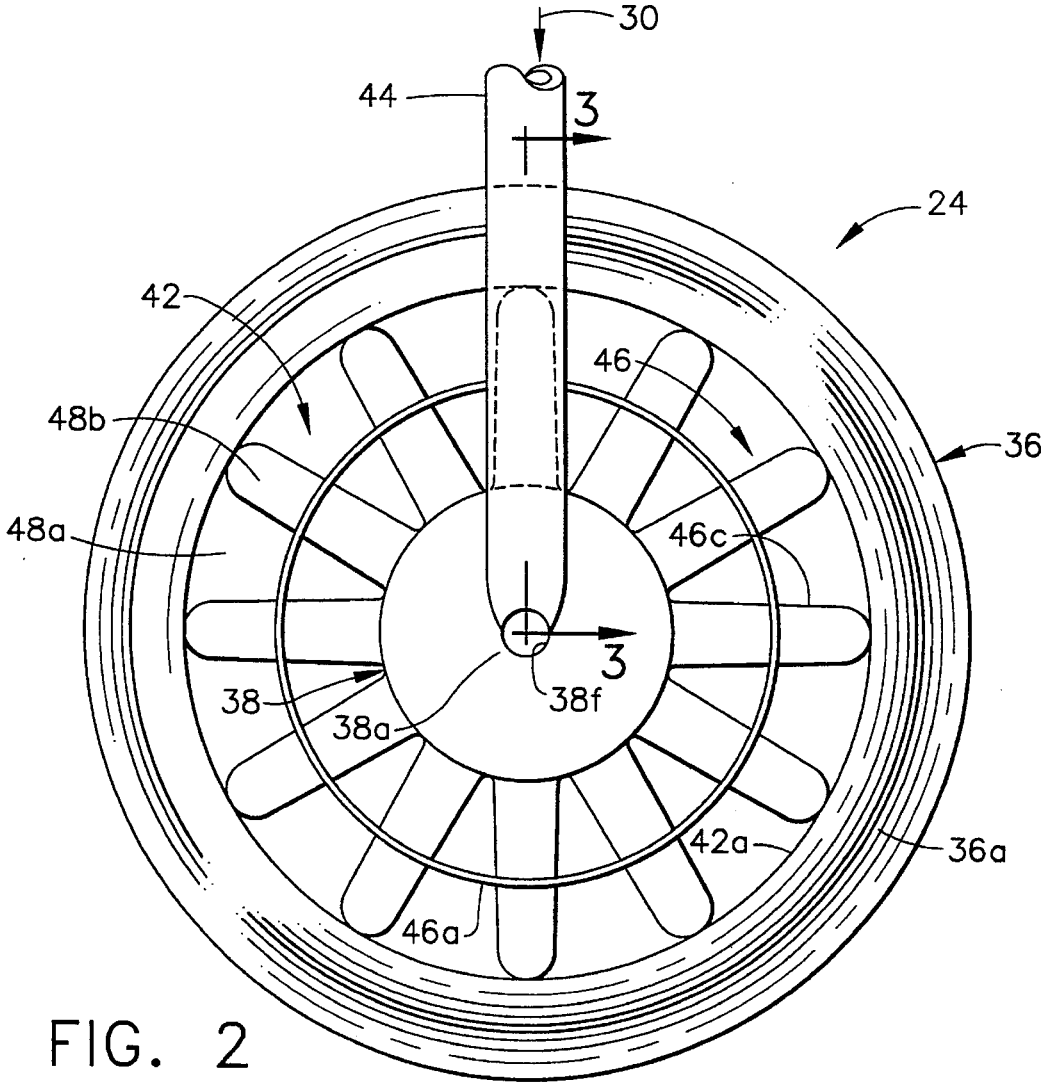
FIG. 2 is an aft facing view of a portion of one of the fuel injectors illustrated in FIG. 1 taken along line 2—2.
Figure 3:
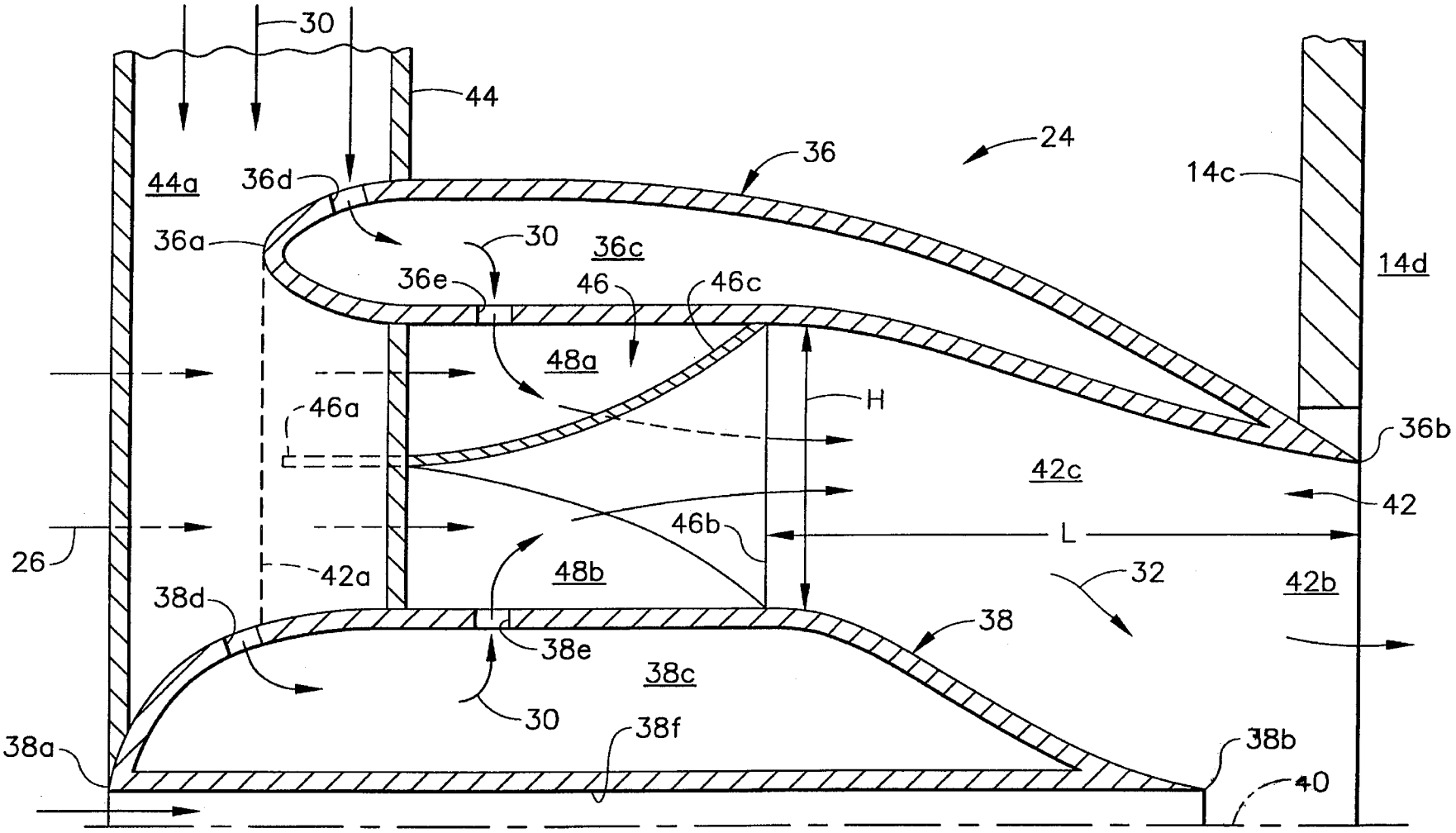
FIG. 3 is an elevational, partly sectional view through a portion of the fuel injector illustrated in FIG. 2 and taken along line 3—3.

An exemplary one of the fuel injectors 24 is illustrated in more particularity in FIGS. 2 and 3. Each injector 24 includes an annular radially outer shell 36 having leading and trailing edges 36*a,b*. An annular radially inner shell 38 is disposed coaxially with the outer shell 36 about an axial centerline axis 40 of the injector 24. The inner shell 38 has leading and trailing edges 38*a,b*, and is spaced radially inwardly from the outer shell 36 to define an annular flow channel 42 therebetween having a channel inlet 42*a* disposed at the shell leading edges 36*a* and 38*a*, and a channel or cup outlet 42*b* disposed at the shell trailing edges 36*b* and 38*b*. The inlet 42*a* receives a respective portion of the compressed air 26.

A preferably hollow fuel strut 44 extends radially outwardly from the inner shell 38 to the outer shell 36 at the leading edges 38*a*, 36*a* thereof and is fixedly joined thereto for supporting both shells 36, 38. The strut 44 extends further radially outwardly through the outer casing 20 as shown in FIG. 1 and is suitably joined in flow communication with the fuel supply 28 for receiving the gaseous fuel 30 therefrom. The strut 44 is suitably mounted to the outer casing 20 and supports the shells 36, 38 for discharging the fuel and air mixture 32 through a corresponding hole in the combustor dome 14*c*.

As shown in FIGS. 2 and 3, an annular lobed mixer 46, also referred to as a daisy mixer, is disposed coaxially in the flow channel 42 and bifurcates the forward portion of the channel 42 into radially outer and inner flowpaths. The mixer 46 includes a preferably cylindrical leading edge 46*a* disposed at the channel inlet 42*a* which radially splits the incoming air 26. The mixer 46 has a downstream trailing edge 46*b* which is spaced axially upstream from the channel outlet 42*b* to define a mixing nozzle 42*c* which is the aft portion of the channel 42.

The mixer 46 further includes a plurality of circumferentially spaced apart serpentine or sinusoidal lobes 46*c* which increase in radial height from the cylindrical leading edge 46*a* to the serpentine trailing edge 46*b* of the mixer 46. Alternating ones of the lobes 46*c* extend radially outwardly to the outer shell 36 and radially inwardly to the inner shell 38. The outer surface of the lobes 46*c* defines with the inner surface of the outer shell 36 a plurality of circumferentially spaced apart radially outer chutes 48*a* through which is channeled a respective outer portion of the inlet air 26. The inner surface of the lobes 46*c* defines with the outer surface of the inner shell 38 a plurality of circumferentially spaced apart radially inner chutes 48*b* for channeling a respective inner portion of the inlet air 26.

Means are provided for injecting the fuel 30 into the lobed mixer 46 for forming the fuel and air mixture 32 in the mixing nozzle 42*c* for discharge through the channel outlet 42*b* into the combustor 14. In the preferred embodiment, the fuel injecting means are effective for injecting the fuel 30 into both of the outer and inner chutes 48*a,b* and preferably into each of the circumferentially spaced apart outer and inner chutes 48*a,b* for providing substantially uniform circumferential distribution of the fuel 30 into the mixer 46.

In a preferred embodiment, the strut 44 is hollow and the fuel injecting means include a fuel channel 44*a* extending longitudinally through the strut 44. The outer shell 36 defines a corresponding annular outer manifold 36*c* disposed therein between outer and inner walls thereof. The outer wall thereof includes a single outer fuel inlet 36*d* disposed in flow communication with the strut fuel channel 44*a* for receiving a portion of the fuel therefrom. A plurality of circumferentially spaced apart outer fuel injection orifices 36*e* are disposed through the inner wall of the outer shell 36 radially above respective ones of the outer chutes 48*a* and are suitably sized for metering and injecting the fuel 30 therein.

Similarly, the fuel injecting means also include an annular inner manifold 38*c* defined between outer and inner walls of the hollow inner shell 38. The outer wall includes a single inner fuel inlet 38*d* disposed in flow communication with the strut fuel channel 44*a* for receiving a portion of the fuel therefrom. A plurality of circumferentially spaced apart inner fuel injection orifices 38*e* are disposed through the outer wall of the inner shell 38 radially below respective ones of the inner chutes 48*b* and are sized for metering and injecting the fuel therein.

In an alternate embodiment, the strut 44 may have two separate passages therein for independently channeling fuel to the outer and inner manifolds, with suitable external control thereof as desired. The strut 44 may also extend radially across the diameters of both shells for allowing additional fuel inlets into the manifolds.

Accordingly, the gaseous fuel 30 may be radially injected into both sides of the mixer 46 for initially mixing with the axially flowing air 26. The fuel and air mixture channeled through the outer chutes 48*a* flows axially and radially inwardly, whereas the fuel and air mixture channeled through the inner chutes 48*b* flows axially and radially outwardly. Effective substantially complete mixing of the fuel and air is accomplished in the mixing nozzle 42*c* between the trailing edge 46*b* of the mixer 46 and the channel outlet 42*b*. The lobed mixer 46 provides effective mixing of the fuel and air without the need for swirling the air or mixture in circumferential directions as occurs in conventional coannular swirlers. The lobed mixer 46 is more effective for mixing the fuel and air in a relatively short axial length as compared to conventional swirlers.

In the exemplary embodiment illustrated in FIG. 3, the mixer trailing edge 46*b* preferably extends radially completely between the outer and inner shells 36, 38 and is suitably fixedly joined thereto at the trailing edges of the lobes 46*c*. The mixer 46 therefore has a maximum radial annulus height H at the trailing edge 46*b* thereof measured between the outer and inner shells 36, 38, with the lobes 46*c* decreasing in height to zero at the mixer inlet 46*a*. The mixing nozzle 42*c* has an axial length L measured between the mixer trailing edge 46*b* and the channel outlet 42*b* at the outer shell trailing edge 36*b*. An effective mixing length L may be as small as or on the order of about one to two times the annulus height H. The mixing length L is substantially smaller than the mixing length required in a conventional coannular swirler which would require about 12–16 times the radial height of both the outer and inner swirl vanes.

In addition to improved mixing in a relatively short axial length, the use of the lobed mixer 46 also ensures maximum axial velocity of the mixture from the channel outlet 42*b* without significant loss due to swirling as found in conventional swirlers. The mixer 46 therefore more effectively allows the discharge axial velocity to exceed the turbulent flame speed of the discharged mixture. And, most significantly, the entire fuel injector 24 may be made substantially smaller and more compact than a conventional injector-swirler design. Yet further, the velocity distribution of the discharged fuel and air mixture 32 is substantially more uniform than that available from conventional swirlers since swirling is not used for mixing the fuel and air.

In the preferred embodiment illustrated in FIG. 3, the outer and inner shells 36, 38 decrease in radius toward the trailing edges 36*b*, 38*b* thereof so that the mixing nozzle 42*c* converges to provide a minimum throat or flow area at the channel outlet 42*b* for metering the air into the combustor 14. The mixing nozzle 42 preferably converges to accelerate the fuel and air mixture 32 discharged from the outlet 42*b* to an axial velocity greater than the turbulent flame speed of the discharged mixture. In this way improved flashback margin is also obtained.

The converging mixing nozzle 42*c* is most important for uncoupling mixing of the fuel and air from metering of the air itself. The channel outlet 42*b* provides the minimum throat area and may therefore be used for accurately metering the air 26. This is a substantial improvement over a conventional swirler design wherein the individual flow passages between adjacent swirl vanes must be accurately controlled in flow area for individually metering the air therethrough. The mixer 46 does not require accurate manufacturing thereof since the individual outer and inner chutes 48*a,b* do not provide the metering function for the air, with metering of the air being collectively provided by the minimum area channel outlet 42*b*.

The radial injection of the fuel 30 through the fuel injection orifices 36*e*, 38*e* is also not critical since the fuel is effectively mixed with the air in the mixing nozzle 42*c*. However, it is desirable that the individual orifices 36*e*, 38*e* are accurately sized for providing substantially uniform circumferential distribution of the fuel 30 for promoting a uniform circumferential distribution and fuel/air ratio of the mixture discharged from the channel outlet 42*b*.

If additional margin against flashback inside the mixing nozzle 42*c* is desired, the outer and inner fuel injection orifices 36*e*, 38*e* may be preferentially sized for effecting rich and lean fuel-to-air ratios in the mixer 46 for preventing combustion thereof prior to effective mixing in the mixing nozzle 42*c*, with the discharge mixture then having a suitable fuel/air ratio for low NOx combustion in the combustor 14. For example, the inner orifices 38*e* may be sized to effect a rich mixture above the combustible rich limit through the inner chutes 48*b*, with the outer orifices 36*e* being sized to effect a lean mixture below the combustible lean limit in the outer chutes 48*a*.

In the preferred embodiment illustrated in FIG. 3, the inner shell 38 preferably includes a center passage 38*f* which extends axially therethrough for directly channeling a portion of only the air 26 to the channel outlet 42*b* bypassing the mixer 46. In this way, an undesirable stagnation point is prevented at the trailing edge 38*b* of the inner shell 38. If desired, the center passage 38*f* could be fueled with a portion of the fuel 30 from the inner manifold 38*c* for undergoing combustion when discharged into the combustor 14.

The improved fuel injector 24 disclosed above significantly decreases the number of dimensions which have to be tightly controlled. Instead of controlling each swirler vane air passage in a conventional swirler, only the aggregate airflow of all the outer and inner chutes 48*a,b* needs to be controlled, which is effectively accomplished by controlling the minimum flow area of the channel outlet 42*b*. Instead of controlling each fuel passage as is done in a conventional swirler-fuel injector, only the circumferential fuel distribution around the mixer 46 needs to be controlled. And, flashback margin is controlled by the axial exit velocity of the mixture 32 from the channel outlet 42*b*, and additionally by stoichiometry control of the relative richness and leanness within the outer and inner chutes 48*a,b*. A more compact and axially shorter design is also effected by using the lobed mixer 46 and relatively short mixing nozzle 42*c* extending downstream therefrom.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. A fuel injector for injecting fuel and air into a gas turbine engine combustor comprising:

an annular outer shell having leading and trailing edges;

an annular inner shell having leading and trailing edges, and disposed coaxially with said outer shell and spaced radially inwardly therefrom to define a flow channel therebetween having an inlet disposed at said shell leading edges for receiving said air, and an outlet disposed at said shell trailing edges;

a strut extending radially outwardly from said inner and outer shells at said leading edges thereof and fixedly joined thereto;

an annular lobed mixer disposed coaxially in said channel, and including a leading edge at said channel inlet, a trailing edge spaced from said channel outlet to define a mixing nozzle, and a plurality of circumferentially spaced apart serpentine lobes increasing in radial height from said leading to trailing edges of said mixer, with said lobes defining with said outer and inner shells corresponding pluralities of outer and inner chutes for separately channeling respective portions of said inlet air as outer and inner air; and means for injecting said fuel into said lobed mixer for forming a fuel and air mixture in said mixing nozzle for discharge through said channel outlet into said combustor.

2. An injector according to claim 1 wherein said outer and inner shells decrease in radius toward said trailing edges thereof so that said mixing nozzle converges to provide a minimum flow area at said channel outlet for metering said air into said combustor.

3. An injector according to claim 2 wherein said mixer has a maximum radial annulus height at said trailing edge thereof, and said mixing nozzle has an axial length on the order of about one to two times said annulus height.

4. An injector according to claim 3 wherein said mixer trailing edge is fixedly joined to said outer and inner shells at said lobes.

5. An injector according to claim 2 wherein said fuel injecting means are effective for injecting fuel into both said outer and inner chutes.

6. An injector according to claim 5 wherein said fuel injecting means are effective for injecting fuel into each of said outer and inner chutes.

7. An injector according to claim 6 wherein said fuel injecting means comprise:

a fuel channel disposed in said strut;

an annular outer manifold disposed in said outer shell, and including an outer fuel inlet disposed in flow communication with said strut fuel channel for receiving fuel therefrom, and a plurality of circumferentially spaced apart outer fuel injection orifices disposed through said outer shell radially above respective ones of said outer chutes for injecting fuel therein; and an annular inner manifold disposed in said inner shell, and including an inner fuel inlet disposed in flow communication with said strut fuel channel for receiving fuel therefrom, and a plurality of circumferentially spaced apart inner fuel injection orifices disposed through said inner shell radially below respective ones of said inner chutes for injecting fuel therein.

8. An injector according to claim 7 further comprising a center passage extending through said inner shell for channeling a portion of said air to said channel outlet.

9. An injector according to claim 7 wherein said outer and inner fuel injection orifices are sized for effecting rich and lean fuel-to-air ratios in said mixer for increasing flashback margin.

10. An injector according to claim 7 wherein said mixing nozzle converges to accelerate said fuel and air mixture discharged from said channel outlet to an axial velocity greater than a turbulent flame speed of said discharged mixture.

* * * * *